United States Patent [19]

Egnell et al.

[11] 4,345,426

[45] Aug. 24, 1982

[54] DEVICE FOR BURNING FUEL WITH AIR

[76] Inventors: Rolf A. Egnell, Bygatan 17, S-240 13 Genarp; Carl-Göran Sjöstedt, Tibastgränd 20, S-230 40 Bara, both of Sweden

[21] Appl. No.: 134,478

[22] Filed: Mar. 27, 1980

[51] Int. Cl.[3] ..... F23R 3/04; F02G 1/04

[52] U.S. Cl. ..... 60/39.23; 60/750; 60/517

[58] Field of Search ..... 60/750, 39.23, 517

[56] References Cited

U.S. PATENT DOCUMENTS

| | | | |
|---|---|---|---|
| 2,817,950 | 12/1957 | Van Weenen et al. | 60/517 |
| 3,656,298 | 4/1972 | Wade | 60/750 |
| 3,744,242 | 7/1973 | Stettler et al. | 60/750 |
| 3,859,794 | 1/1975 | Hakansson . | |
| 4,044,553 | 8/1977 | Vaught | 60/39.23 |
| 4,069,670 | 1/1978 | Bratt et al. | 60/517 |
| 4,277,942 | 7/1981 | Egnell et al. | 60/517 |

*Primary Examiner*—Robert E. Garrett

*Attorney, Agent, or Firm*—Finnegan, Henderson, Farabow, Garrett & Dunner

[57] ABSTRACT

A device for burning fuel with air is provided with means for causing partly recirculation of the combustion gases prior to their exit via a preheater. The degree of recirculation may be governed by a parallel path having controllable flow resistance and in which no recirculation occurs.

9 Claims, 2 Drawing Figures

DEVICE FOR BURNING FUEL WITH AIR

PRIOR ART REFERENCES

U.S. Pat. No. 2,817,950;
U.S. Pat. No. 3,859,794;
U.S. Pat. No. 4,069,670;
U.S. Pat. Ser. No. 971,876;
U.S. Pat. Ser. No. 16,079.

FIELD OF THE INVENTION

This invention relates to a device in which the combustion gases are at least partly recirculated in order to reduce the peak combustion temperature and reduce formation of nitrogen oxides.

DESCRIPTION OF THE PRIOR ART

It is known that a recirculation of combustion gases will reduce the formation of nitrogen oxides. A recent development in this technical field has been described in the U.S. patent application Ser. No. 016,079 filed Feb. 28, 1979, now U.S. Pat. No. 4,277,942.

It is, however, desirable to design a device that may be used for controlling the amount of recirculating gases and the pressure drop.

SUMMARY OF THE INVENTION

A device for burning fuel with air and in which the combustion gases are at least partly recirculated, said device comprising primary walls defining adjacent passages for exhaust gases and air supplied for the combustion, said walls forming a heat exchanger for heating the air and cooling the exhaust gases, secondary walls defining a passage for an air flow leaving the preheater and for directing said air flow to a single fuel nozzle, further walls limiting a number of paths for guiding a combustion gas flow from a location near said heat exchanger to a location near said nozzle to cause a recirculation of a part of the combustion gases, still further walls defining ejector nozzles for guiding a part of the preheated air leaving the preheater into each of said paths to activate a recirculation of a part of the combustion gases, is according to the invention characterized in that said passage for directing said air flow to said single fuel nozzle comprises governing means for regulating said air flow.

The invention will be described in more detail reference being made to the accompaning drawings.

DESCRIPTION OF THE PREFERRED EMBODIMENT

Figure 1:
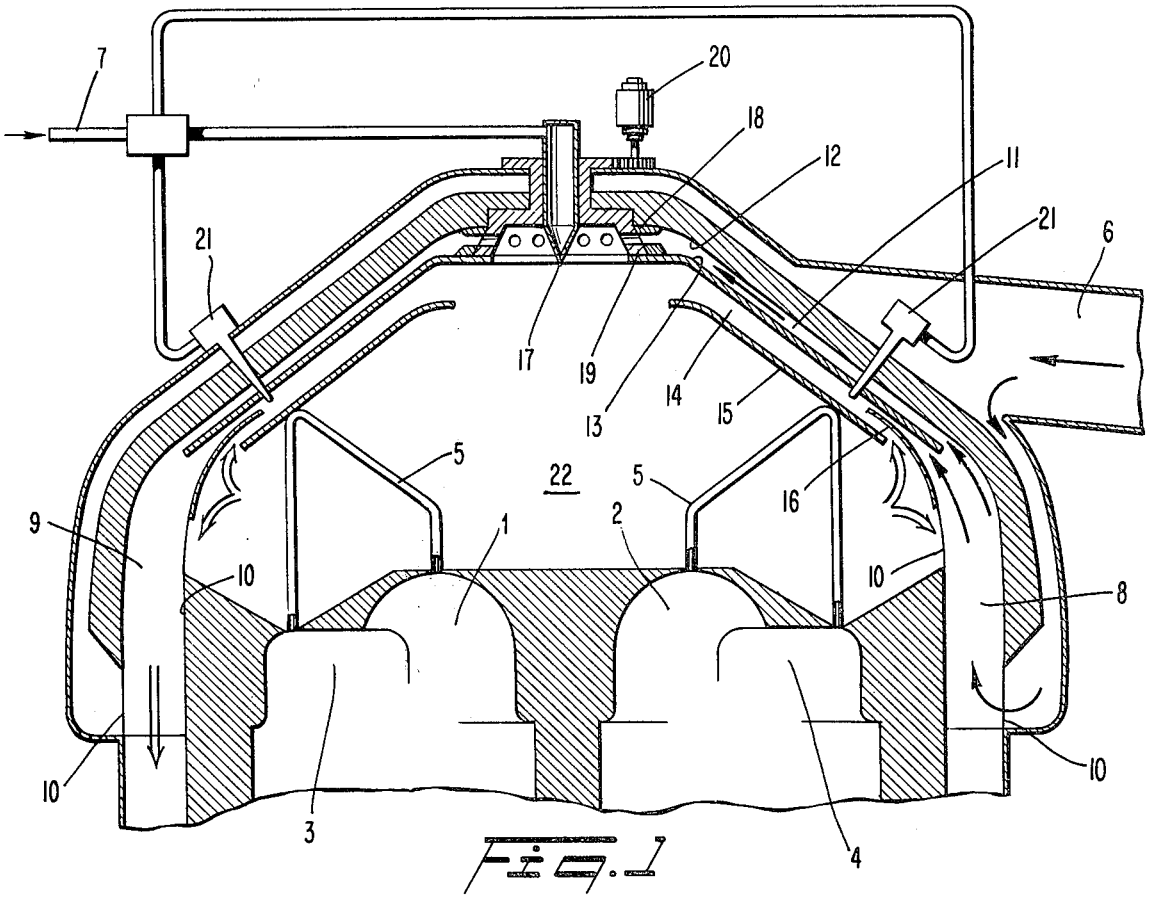
FIG. 1 is a vertical section of a schematic representation of an embodiment of the present invention and FIG. 2 is a section along the line II—II of FIG. 1.
Figure 2:
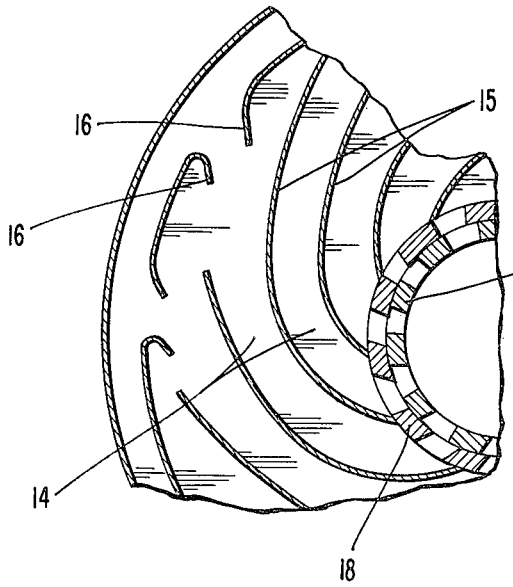

The embodiment shown of a device for burning fuel with air is a part of a hot gas engine of the type described e.g. in the U.S. patent application No. 884,356, now U.S. Pat. No. 4,195,554. Such engine comprises cylinders 1, 2 and regenerators 3, 4 interconnected by a heater head consisting of tubes 5 containing a working medium to be heated. A heater head design of suitable type has been described in more detail in the U.S. Pat. No. 4,069,670.

Air for the combustion is delivered from a blower (not shown) via a duct 6 and fuel is delivered from a pump (not shown) via a conduit 7. The amount of air delivered is governed in response to the demand of heat and the amount of fuel is governed in proportion to the mass flow of air. Such systems are known per se and have been described e.g. in the U.S. Pat. No. 3,859,794.

The air from the duct 6 is delivered to a preheater in which a number of passages 8 for air are alternating with adjacent passages 9 for exhaust gases. Thus the exhaust gases will give off latent heat to the combustion air. A heat exchanger—preheater device of the type—has been described in the U.S. patent application Ser. No. 971,876. Primary walls 10 define the passages 8, 9.

The air flow leaving the preheater 8, 9 may—as shown in the right hand side of FIG. 1—pass either through a passage 11 defined by secondary walls 12, 13 or through a number of paths 14 limited by further walls 15.

Still further walls 1 define ejector nozzles for guiding a part of the preheated air leaving the preheater into each of said paths 14, which are leading to a centrally mounted, single fuel injection nozzle 17. Also the passage 11 will direct the preheated air to said nozzle 17. However, this passage 11 ends up with a valve consisting of two concentrically mounted valve rings 18, 19. The outer valve ring 18 is stationary while the inner ring 19 is angularly displaceable by means of a motor 20. The two valve rings 18, 19 are provided with holes of equal number and position. Thus air may be allowed to pass through the valve rings at varying pressure drop dependent on the angular position of the ring 18.

Further fuel injection nozzles 21 are mounted in the paths 14 to spray fuel into the flows directed towards the nozzle 17. The velocity of the flows is greater than the flame propagation. Thus an ignition near the central nozzle 17 will not case any burning in the paths 14.

In case it is desired to decrease the pressure drop or the amount of recirculating gases an increase of the mass flow of combustion air delivered via the duct 6 will occur. The valve ring 18 will be moved into a position in which the pressure drop in the valve 18, 19 is reduced and combustion air without contents of recirculated combustion gases will reach the central nozzle 17 and mix with fuel supplied through said nozzle 17 and burnt in a central part 22 of the device.

The combustion gases will pass the tubes 5 (as shown with double arrows) and either—as shown in the right hand side of FIG. 1—be recirculated through the paths 14—or as shown in the left hand side of FIG. 1—they may leave the device through the preheater.

We claim:

1. A device for burning fuel with air and in which the combustion gases are at least partially recirculated, said device comprising:

primary walls defining a preheater having adjacent passages for exhaust gases and air supplied for the combustion, said preheater for heating the air and cooling the exhaust gases; secondary walls defining a passage for a first part of the air flow leaving the preheater and for directing said first air flow to a single fuel nozzle; further walls forming a number of paths for guiding a part of combustion gas flow from a location near said heat exchanger to a location near said nozzle to cause a recirculation of said part of the combustion gases;

still further walls defining ejector nozzles for guiding a second part of the preheated air leaving the preheater into each of said paths to provide the driving force for the recirculation of said part of the combustion gases; and means for indirectly controlling the amount of combustion gases recirculated in said paths, said control means including governing means positioned in said passage for regulating said first air flow.

2. A device as claimed in claim 1, characterized in that an auxiliary fuel nozzle is positioned in a path for recirculation to inject fuel into said flow of recirculated combustion gas.

3. Improved apparatus for burning fuel with combustion air in a central combustor region to produce combustion gases, the apparatus including a preheater for preheating the combustion air using heat from the resultant combustion gases, and ejectors powered by the combustion air and disposed in a peripheral combustor region containing combustion gases to recirculate a portion of the combustion gases to the central region, the improvement comprising:

(a) means for dividing the combustion air into at least two parallel streams, the air in one of said two streams being channeled to the air ejectors, and the air in the other of said two streams being channeled directly into the central combustor region bypassing the air ejectors; and (b) means for indirectly controlling the amount of combustion gases recirculated by said one stream, said indirect control means including controllable valve means positioned in the flow path of said other air stream.

4. Improved apparatus as in claim 3 wherein the apparatus includes a centrally positioned fuel injection nozzle, and wherein said dividing and channeling means includes an annular wall extending to the vicinity of, and encircling, the fuel nozzle, an annular gap being formed between the fuel nozzle and the proximate smaller diameter edge of said wall, the air ejectors mounted at the distant larger diameter edge of said wall, the opposite planar sides of said wall forming part of respective passageways for carrying said one and said another air streams, said valve means being positioned to controllably vary the air flow through said annular gap.

5. Improved apparatus as in claim 4 wherein said valve means includes a pair of concentric, radially perforated rings, one of said rings being rotatable relative to the other for changing the degree of alignment of the perforations in one of said ring pair with the perforations in the other ring of said pair, the pressure drop through said valve means and thus the air flow in said other stream being directly varied with the change in alignment, and wherein said valve means further includes actuator means operatively connected to said ring pair to effect controlled relative movement.

6. Improved apparatus as in claim 3 or 4 wherein said one air stream formed by said dividing and channeling means is positioned between the central combustion region and said other air stream.

7. Improved apparatus as in claim 3 wherein said dividing and channeling means is positioned to intercept the combustion air after it leaves the preheater.

8. Improved apparatus as in claim 3 wherein said valve means also comprises means for controllably varying the overall combustion air pressure drop from the ambient to the central combustor region.

9. Method for controlling the amount of combustion gases recirculated in a device for burning fuel with air in a central combustor region, the device including ejectors positioned in a peripheral combustor region containing combustion gases and powered by the incoming air for effecting recirculation of a portion of the combustion gases back to the central combustor region, the method comprising the steps of:

(a) dividing the incoming air into two parallel flow streams, said streams having a common pressure point at the central combustor region and another common pressure point upstream of the peripheral combustor region;

(b) channeling one of said parallel streams through the ejectors to power the ejectors and to entrain the recirculated combustion gases;

(c) channeling the other of said parallel streams directly to the central combustor region; and (d) controllably throttling the other of said parallel streams for indirectly controlling the mass flow rate of air in the one parallel streams and the amount of combustion gases recirculated by the ejectors.

* * * * *